US008154179B2

(12) United States Patent
Chen

(10) Patent No.: US 8,154,179 B2
(45) Date of Patent: Apr. 10, 2012

(54) LIGHT EMITTING DIODE LAMP HAVING REPLACEABLE LIGHT SOURCE MODULE

(76) Inventor: Tsan-Chi Chen, Chung Ho (TW)

( * ) Notice: Subject to any disclaimer, the term of this patent is extended or adjusted under 35 U.S.C. 154(b) by 317 days.

(21) Appl. No.: 12/654,054

(22) Filed: Dec. 9, 2009

(65) Prior Publication Data

US 2011/0133652 A1 Jun. 9, 2011

(51) Int. Cl.
*H01J 61/52* (2006.01)

(52) U.S. Cl. ..... 313/46; 313/47; 362/294; 362/647; 362/650

(58) Field of Classification Search ..... 313/46, 313/47; 362/294, 647, 650; 315/112
See application file for complete search history.

(56) References Cited

U.S. PATENT DOCUMENTS 5,545,950 A * 8/1996 Cho ..... 315/56
7,892,031 B1 * 2/2011 Mostoller et al. ..... 439/611
2006/0227558 A1 * 10/2006 Osawa et al. ..... 362/351
2010/0096992 A1 * 4/2010 Yamamoto et al. ..... 315/112
2010/0128479 A1 * 5/2010 Biebl et al. ..... 362/249.02
2010/0232168 A1 * 9/2010 Horng et al. ..... 362/373
2010/0265727 A1 * 10/2010 Liu ..... 362/373
2011/0050072 A1 * 3/2011 Liu ..... 313/46

* cited by examiner

*Primary Examiner* — Douglas W Owens
*Assistant Examiner* — Thai Pham
(74) *Attorney, Agent, or Firm* — Bacon & Thomas, PLLC

(57) ABSTRACT

The present invention is a LED lamp, which comprises an insulation body having a first end electrically installed onto a lamp holder and a second end electrically connected to the first end, a heat dissipation element sleeved on the insulation body, and a light source module electrically and movably connected to the second end, wherein the light source module includes at least one LED, each of the LED is electrically mounted on a lower surface of a printed circuit board, and a lower surface and a upper surface of a heat dissipation plate are connected to an upper surface of the printed circuit board and a lower surface of the heat dissipation element respectively. Since the light source module is electrically and movably connected to the second end, a user can replace the light source module without replacing the whole LED lamp when the light source module is damaged.

6 Claims, 6 Drawing Sheets

LIGHT EMITTING DIODE LAMP HAVING REPLACEABLE LIGHT SOURCE MODULE

FIELD OF THE INVENTION

The present invention relates to a light emitting diode (LED) lamp, more particularly to a LED lamp having a replaceable light source module for enabling a user to selectively replace the light source module without replacing the whole LED lamp when the light source module is damaged or long-term used.

BACKGROUND OF THE INVENTION

Traditionally, a light emitting diode (LED) lamp is used to improve high power consumption of lamps. Referring now to FIG. 1, a lamp 1 comprises a body 10 and a light source module 11, wherein the body 10 has an upper end provided with a connector portion 100. The lamp 1 can be installed on a lamp holder (not shown) by the connector portion 100. The connector portion 100 has an upper end provided with a positive electrode 101, and a side periphery which is close to the connector portion 100 and provided with a negative electrode 102. The body 10 is further formed with a receiving space 103 therein, wherein the receiving space 103 receives a power driver 104 which is electrically connected to the positive electrode 101 and the negative electrode 102 of the connector portion 100 via a respective wire 105. Furthermore, the light source module 11 comprises a plurality of LEDs 110 and a circuit substrate 111, wherein the LEDs 110 are mounted on a lower surface of the circuit substrate 111, while an upper surface of the circuit substrate 111 is attached to a lower surface of the body 10 and electrically connected to the power driver 104 via two electrical wires 112 passing through the lower surface of the body 10.

Therefore, when the lamp 1 is installed on a lamp holder by a user, the electric power from the lamp holder can be supplied to the power driver 104 via the positive electrode 101, the negative electrode 102 and the wires 105 of the connector portion 100, and then the power driver 104 can drive the LEDs 110 through the electrical wires 112 to emit light.

However, there are still some disadvantages existing in the lamp 1. Generally, the service life of LEDs 110 is apparently shorter than that of the body 10 and the power driver 104 therein. However, the upper surface of the circuit substrate 111 of the light source module 11 is fixedly attached to the lower surface of the body 10 and electrically connected to the power driver 104 in the body 10 via the electrical wires 112. As a result, when any one of the LEDs 110 is damaged or the light generated therefrom is attenuated due to long-term use, the light source module 11 can not be singly detached or replaced by the user, and the whole lamp 1 must be replaced. Even though the body 10, the power driver 104 and other lamp elements are still workable, the lamp elements must be discarded, resulting in unnecessary waste of the lamp elements. Because the amount and the occupied space of the wasted lamp 1 is substantially increased, the use of the lamp 1 apparently can not meet the original design purpose of using the lamp 1 (i.e. saving energy and reducing carbon emissions for green environmental protection), while the cost of repairing and replacing the lamp 1 by the user can not be efficiently lowered down.

As a result, it is important for related manufacturers and designers of LED lamps to think how to develop a novel LED lamp to improve the foregoing disadvantages of the traditional LED lamps, in such a way that it is unnecessary for the user to replace the whole lamp when the LEDs of the lamp is damaged or long-term used. Therefore, the purpose of efficiently saving energy and reducing carbon emissions for green environmental protection can be carried out, the unnecessary waste of the lamp elements can be reduced, and the cost of repairing and replacing the lamps by the user can be efficiently lowered down.

It is therefore tried by the inventor to develop an LED lamp having a replaceable light source module to solve the problems existing in the traditional LED lamps as described above, so that the user can conveniently detach a light source module from a lamp and install another light source module onto the lamp. Therefore, when the light source module is long-term used or damaged, the user can individually replace the light source module, so as to efficiently solve the problem of replacing the whole traditional lamp.

BRIEF SUMMARY OF THE INVENTION

An object of the present invention is to provide a light emitting diode (LED) lamp having a replaceable light source module, which comprises an insulation body having a first end provided with a first installation portion which is used to install onto a lamp holder and has at least two first electrically conductive elements electrically connected to the lamp holder, and a second end provided with a second installation portion which has at least two second electrically conductive elements therein electrically connected to the first electrically conductive elements. The LED lamp further comprises a heat dissipation element sleeved on the second end of the insulation body, and a light source module which includes at least one LED, a printed circuit board, a heat dissipation plate and a third installation portion, wherein each of the LED is mounted on a lower surface of the printed circuit board, a lower surface and an upper surface of the heat dissipation, plate are connected to an upper surface of the printed circuit board and a first end of the third installation portion, respectively, and a second end of the third installation portion is provided with at least two third electrically conductive elements. The printed circuit board is electrically connected to the third electrically conductive elements through at least two power wires. When the second installation portion is combined with the third installation portion, the second electrically conductive elements is electrically connected to the third electrically conductive elements, so that each of the LED can receive an electric power supplied by the lamp holder through the printed circuit board and the first, second and third electrically conductive elements. As a result, when the light source module is damaged or long-term used, a user can selectively replace the light source module without replacing the whole LED lamp, so as to carry out the purpose of efficiently saving energy and reducing carbon emissions for green environmental protection.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
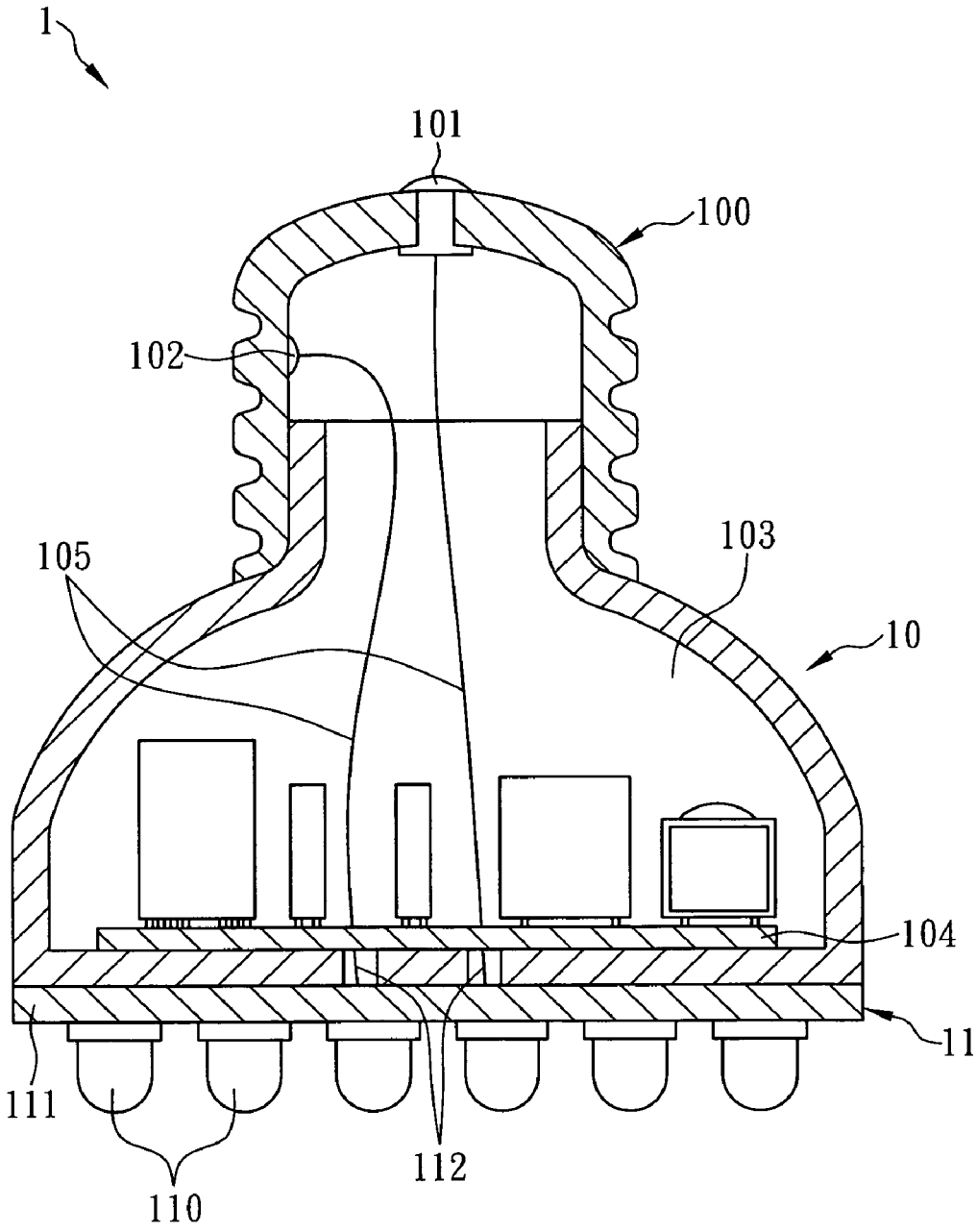
FIG. 1 (Prior Art)
FIG. 1 is a cross-sectional view of a traditional LED lamp.
Figure 2:
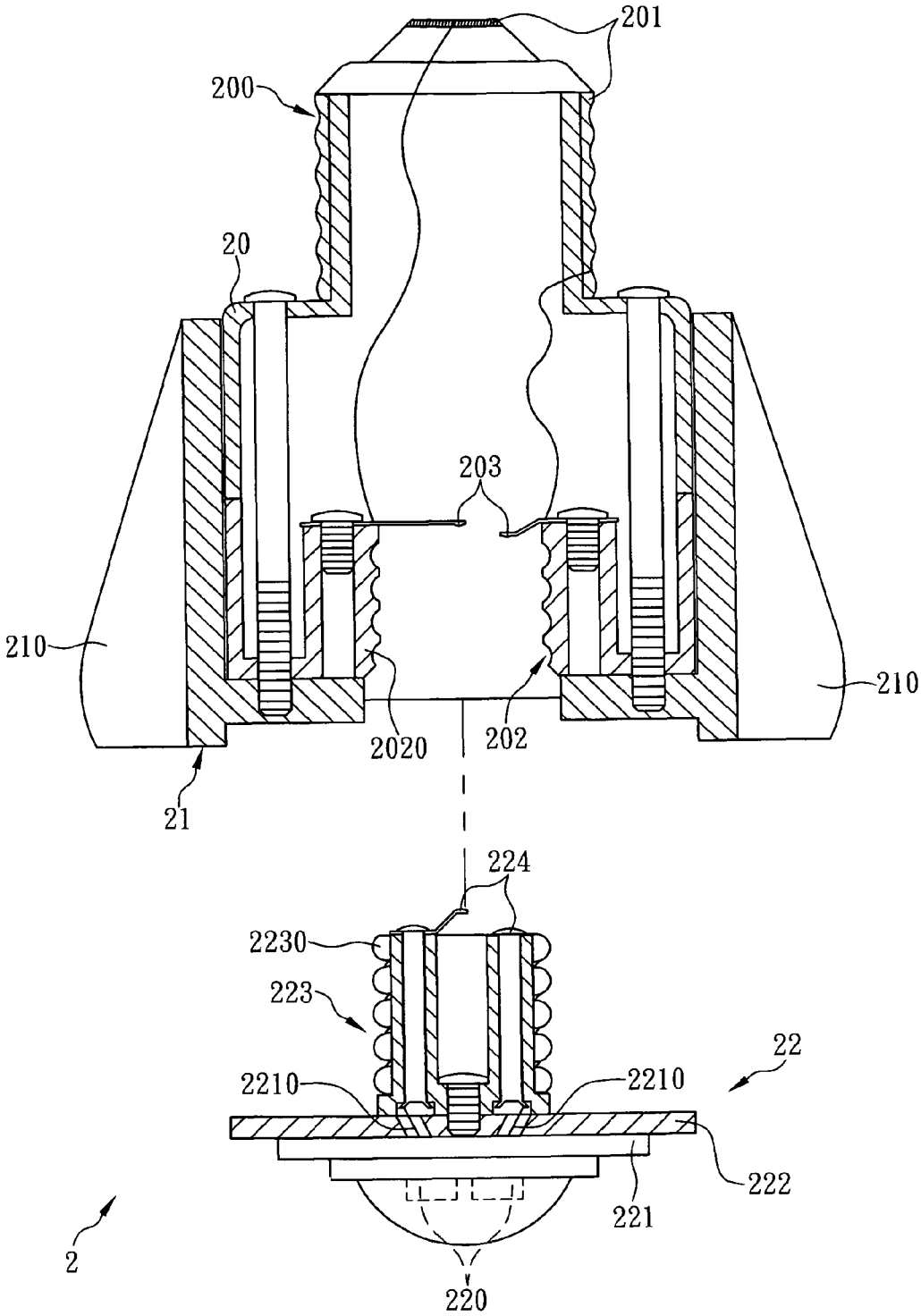
FIG. 2 is an exploded cross-sectional view of an LED lamp according to a first preferred embodiment of the present invention.

The present invention is related to a light emitting diode (LED) lamp having a replaceable light source module. Referring now to FIG. 2, in a first preferred embodiment of the present invention, an LED lamp 2 comprises an insulation body 20, a heat dissipation element 21 and a light source module 22, wherein the insulation body 20 is hollow, and has a first end provided with a first installation portion 200 which has at least two first electrically conductive elements 201 (for being electrically connected to two different electrodes of an electric power), so that the LED lamp 2 can be installed onto a lamp holder (not shown) by the first installation portion 200, and electrically connected to the lamp holder via the first electrically conductive elements 201 for receiving the electric power supplied by the lamp holder. The insulation body 20 further has a second end provided with a second installation portion 202 which has at least two second electrically conductive elements 203 therein (for being electrically connected to two different electrodes of an electric power), wherein the second electrically conductive elements 203 are electrically connected to the first electrically conductive elements 201, respectively. The second end of the insulation body 20 has an outer periphery sleeved with the heat dissipation element 21 which is formed with a plurality of heat dissipation fins 210, wherein each of the heat dissipation fins 210 is separated from each other about a predetermined pitch. Furthermore, the light source module 22 includes at least one LED 220, a printed circuit board 221, a heat dissipation plate 222 and a third installation portion 223, wherein each said LED 220 is mounted on a lower surface of the printed circuit board 221, and a lower surface of the heat dissipation plate 222 is connected to an upper surface of the printed circuit board 221. The third installation portion 223 is provided with at least two third electrically conductive elements 224 (for being electrically connected to two different electrodes of an electric power). The printed circuit board 221 is electrically connected to the third electrically conductive elements 224 via at least two power wires 2210 passing through the heat dissipation plate 222, respectively. The third installation portion 223 is matched with the second installation portion 202, and combined with each other.

According to the foregoing assembly, the third electrically conductive elements 224 can be electrically connected to the second electrically conductive elements 203, respectively, so that each said LED 220 can receive the electric power supplied by the lamp holder through the printed circuit board 221, the third electrically conductive elements 224, the second electrically conductive elements 203, and the first electrically conductive elements 201 in turn. Meanwhile, a portion of an upper surface of the heat dissipation plate 222 close to a peripheral edge thereof can be attached to the heat dissipation element 21, so that waste heat generated due to the illumination of each said LED 220 can be distributed to the heat dissipation fins 210 of the heat dissipation element 21 through the printed circuit board 221 and the heat dissipation plate 222 in turn and speedily dissipated to an external environment. Therefore, when the light source module 22 of the LED lamp 2 is damaged or the light emitted by any said LED 220 is attenuated due to long-term use, the light source module 22 can be singly detached and replaced by a user without replacing the whole LED lamp 2. As a result, the waste of lamp elements (such as the insulation body 20, the heat dissipation element 21, etc.) can be substantially reduced, while the amount and the occupied space of wasted lamp elements can be efficiently substantially reduced, so as to carry out the purpose of efficiently saving energy and reducing carbon emissions for green environmental protection.

Referring back to FIG. 2, in the preferred embodiment of the present invention, the first installation portion 200 is a projected column and an outer surface thereof has a thread matched with an installation hole (not shown) of the lamp holder. Meanwhile, the second installation portion 202 is a recess, and an inner surface thereof has a first thread unit 2020. The third installation portion 223 is a projected column and an outer surface thereof has a second thread unit 2230 which can be matched with the first thread unit 2020, so that the second installation portion 202 can be stably connected to the third installation portion 223. Hence, the user can easily install the LED lamp 2 onto the lamp holder by the first installation portion 200. When the user needs to detach the light source module 22 from the LED lamp 2 or install the light source module 22 onto the LED lamp 2, the user can conveniently detach the light source module 22 from the LED lamp 2 or install the light source module 22 onto the LED lamp 2 through the first thread unit 2020 of the second installation portion 202 and the second thread unit 2230 of the third installation portion 223.

Figure 3:
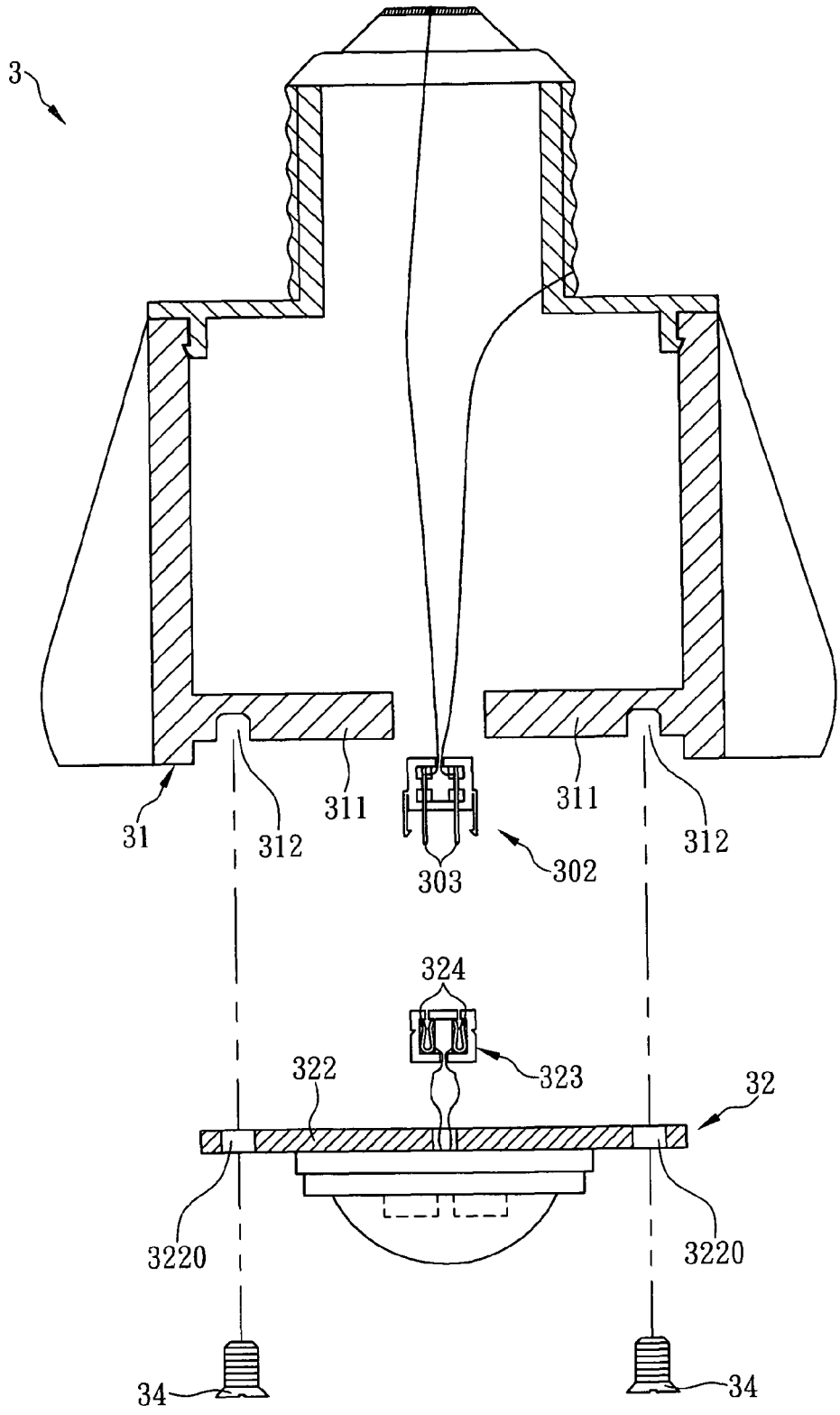
FIG. 3 is an exploded cross-sectional view of an LED lamp according to a second preferred embodiment of the present invention.

In a second preferred embodiment of the present invention, referring now to FIG. 3, an LED lamp 3 is illustrated and similar to the LED lamp 2 of the first preferred embodiment, wherein a lower end of a heat dissipation element 31 is extended toward an axis thereof to form an extension portion 311 which is formed with at least two first fixation units 312. Meanwhile, a heat dissipation plate 322 of a light source module 32 is formed with at least two second fixation units 3220. Each of the second fixation units 3220 is corresponding to and matched with a respective said first fixation unit 312 so that the second fixation units 3220 and the first fixation units 312 can be combine with each other. As shown in FIG. 3 of the preferred embodiment, for example, each of the first fixation units 312 and the second fixation units 3220 is a fastening hole and can be fastened with each other by a fastening unit 34. However, in an actual practice, each of the first fixation units 312 and the second fixation units 3220 is not limited thereto, and can be designed to a pair of corresponding configurations which can be directly engaged with each other. In such a way, when the user installs the light source module 32 onto the LED lamp 3, the light source module 32 can be stably installed onto the LED lamp 3 through each of the first fixation units 312 and the second fixation units 3220, so as to efficiently increase the structural strength of the LED lamp 3.

Figure 4:
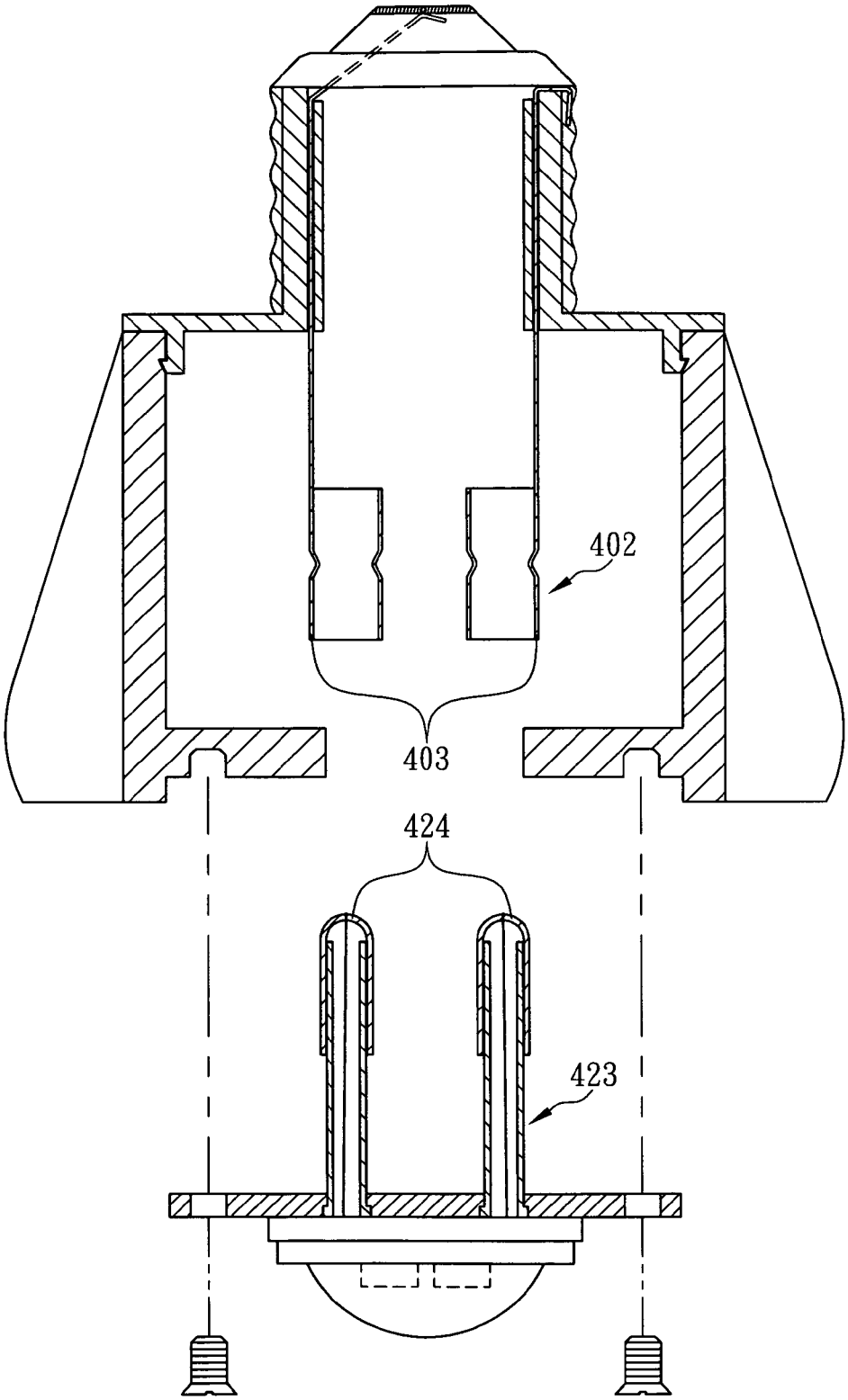
FIG. 4 is an exploded cross-sectional view of an LED lamp according to a third preferred embodiment of the present invention.
Figure 5:
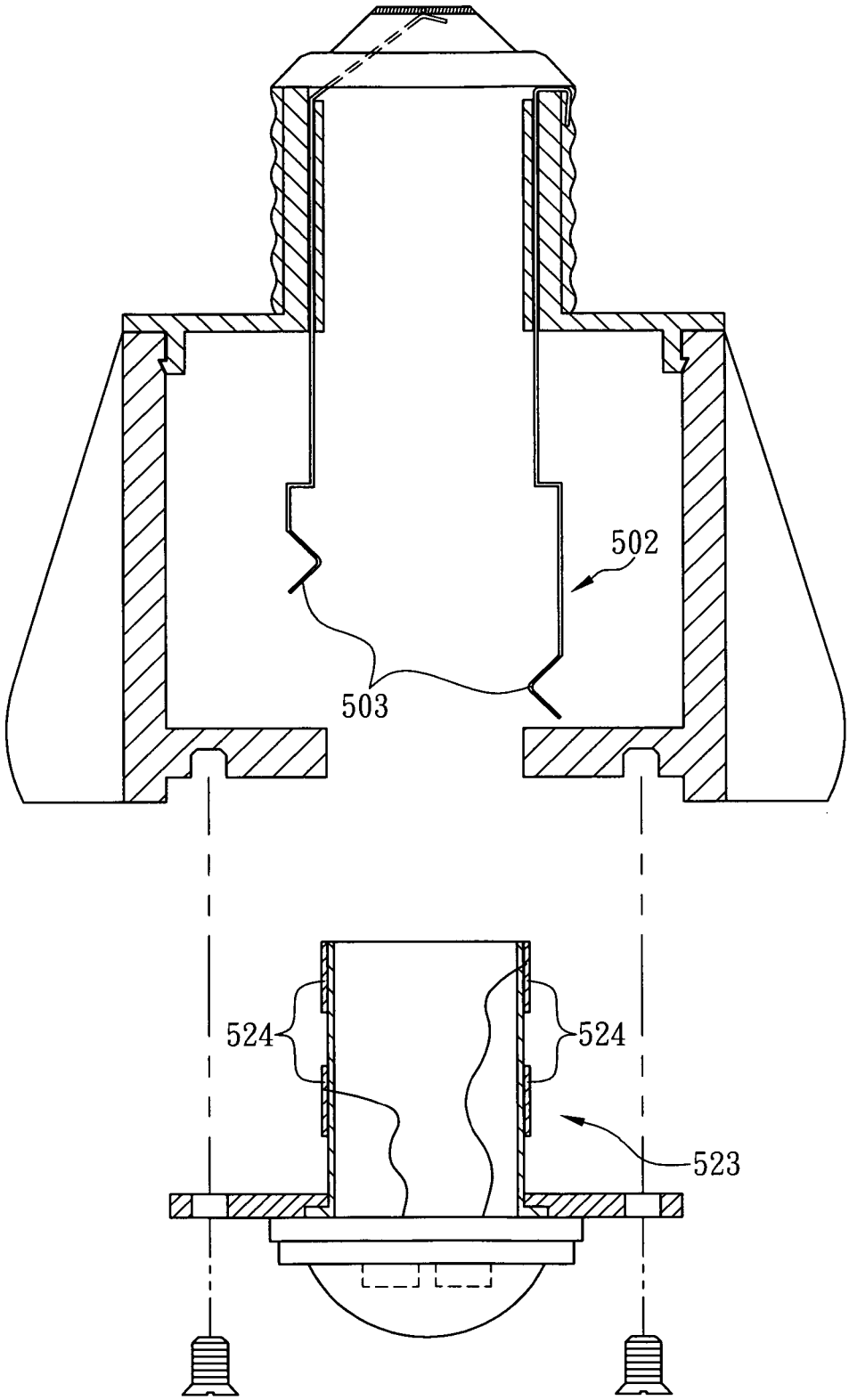
FIG. 5 is an exploded cross-sectional view of an LED lamp according to a fourth preferred embodiment of the present invention.

Referring back to FIG. 2, in the first preferred embodiment of the present invention, the second installation portion 202 and the third installation portion 223 are not limited to the recess having the first thread unit 2020 and the projected column having the second thread unit 2230 and match with the recess, respectively. Referring to FIG. 3, in the second preferred embodiment of the present invention, a second installation portion 302 and a third installation portion 323 are a pair of insertion sheets matched with each other, wherein the second installation portion 302 is provided with two second electrically conductive elements 303, while the third installation portion 323 is provided with two third electrically conductive elements 324. When the second installation portion 302 is inserted into the third installation portion 323 by the user, the second electrically conductive elements 303 can be electrically connected to the third electrically conductive elements 324, respectively. Moreover, referring now to FIG. 4, in a third preferred embodiment of the present invention, a second installation portion 402 is installation sleeves, and a third installation portion 423 is insertion posts matched with the installation sleeves. When the third installation portion 423 is inserted into the second installation portion 402, two second electrically conductive elements 403 of the second installation portion 402 can be electrically connected to two third electrically conductive elements 424 of the third installation portion 423, respectively. In addition, referring now to FIG. 5, in a fourth preferred embodiment of the present invention, a second installation portion 502 is electrically conductive elastic sheets, and a third installation portion 523 is insertion posts matched with the electrically conductive elastic sheets. When the third installation portion 523 is inserted into the second installation portion 502, two second electrically conductive elements 503 of the second installation portion 502 can be electrically connected to two third electrically conductive elements 524 disposed on an outer periphery of the third installation portion 523, respectively. Besides, referring now to FIG. 6, in a fifth preferred embodiment of the present invention, a second installation portion 602 is electrically conductive elastic sheets, and a third installation portion 623 is electrically conductive contacts matched with the electrically conductive elastic sheets. When the third installation portion 623 is in contact with the second installation portion 602, two second electrically conductive elements 603 of the second installation portion 602 can be electrically connected to two third electrically conductive elements 624 of the third installation portion 623, respectively. Therefore, as described above, the second installation portion and the third installation portion of the present invention can be various structural configurations which can be designed by one person skilled in the art, and not limited to the foregoing structural configurations of the first to fifth embodiments. Only if a second installation portion and a third installation portion can be used to connect the light source module to the LED lamp and allow each of the LED to receive the electric power supplied from the lamp holder during installing the light source module onto the LED lamp by the user, the type of the second installation portion and the third installation portion can be applied to the present invention.

Figure 6:
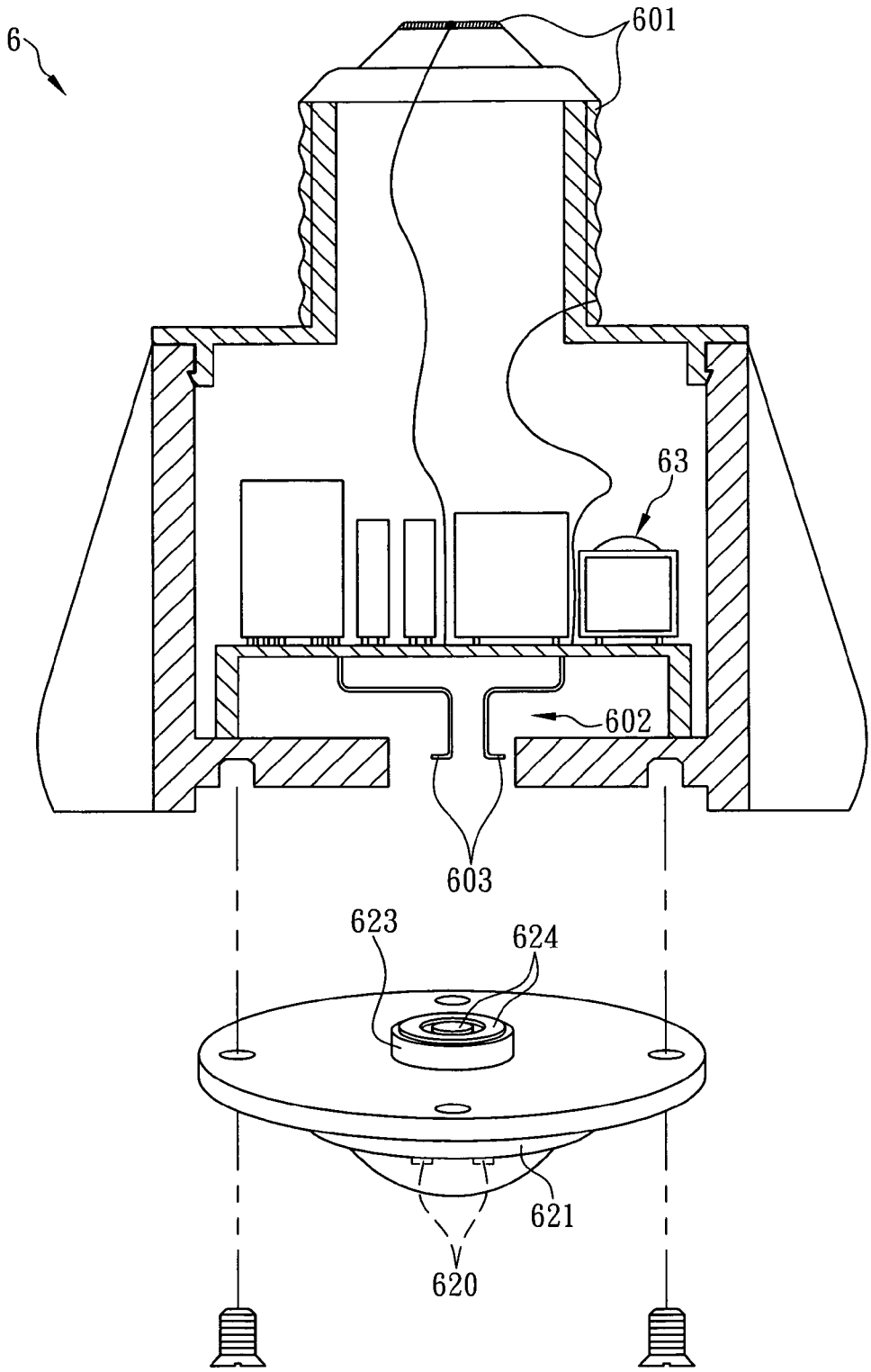
FIG. 6 is an exploded cross-sectional view of an LED lamp according to a fifth preferred embodiment of the present invention.

Referring to FIG. 6, in the fifth preferred embodiment of the present invention, an LED lamp 6 further comprises a power driver 63 between two first electrically conductive elements 601 and the second electrically conductive elements 603, wherein the power driver 63 is used to convert the electric power transmitted from the first electrically conductive elements 601 to the second electrically conductive elements 603. For example, the power driver 63 is used to convert an alternating current (AC) into a direct current (DC). Thus, in a case that the electric power supplied by the lamp holder is AC power, a manufacturer can use a printed circuit board 621 and LEDs 620 with a general DC-power specification. As a result, the power driver 63 can convert the AC power supplied by the lamp holder into a DC power which can be then provided to the printed circuit board 621 and the LEDs 620, so as to prevent the burned or damaged problem due to different power specification of the printed circuit board 621 and the LEDs 620.

Referring back to FIG. 2, in the foregoing preferred embodiments of the present invention, the first installation portion 200 is not limited to the projected column or have the thread, wherein the first installation portion 200 also can be a structural configuration having two connection wires. Thus, the user can connect each of the two connection wires of the first installation portion 200 to corresponding power wires in a ceiling or a side wall. As a result, the insulation body 20 and the heat dissipation element 21 can be defined as a lamp holder, and the user can simply install the light source module 22 thereto to constitute a whole LED lamp 2. In other words, only if the user can install the LED lamp 2 on the lamp holder or allow the LED lamp 2 to receive the electric power by a first installation portion 200, the type of the first installation portion 200 can be applied to the present invention.

As described above, referring still to FIG. 2, according to the LED lamp 2 of the present invention, when the light source module 22 is damaged or long-term used; the user can selectively replace the light source module 22 without replacing the whole LED lamp 2, so as to substantially reduce the waste of lamp elements and carry out the purpose of efficiently saving energy and reducing carbon emissions for green environmental protection.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A light emitting diode (LED) lamp having a replaceable light source module, comprising:

an insulation body being hollow, and having a first end provided with a first installation portion which has at least two first electrically conductive elements, wherein the LED lamp receives an electric power via the first electrically conductive elements, and the insulation body further having a second end provided with a second installation portion which has at least two second electrically conductive elements, wherein the second electrically conductive elements are electrically connected to the first electrically conductive elements, respectively;

a heat dissipation element sleeved on an outer periphery of the second end of the insulation body, and formed with a plurality of heat dissipation fins; and a light source module including at least one LED, a printed circuit board, a heat dissipation plate and a third installation portion, wherein each said LED is mounted on a lower surface of the printed circuit board, a lower surface of the heat dissipation plate being connected to an upper surface of the printed circuit board, and the third installation portion being provided with at least two third electrically conductive elements, wherein the printed circuit board is electrically connected to the third electrically conductive elements via at least two power wires passing through the heat dissipation plate, respectively, so that each said LED receives the electric power supplied by an external lamp holder through the printed circuit board, the third electrically conductive elements, the second electrically conductive elements, and the first electrically conductive elements in turn, while a portion of an upper surface of the heat dissipation plate close to a peripheral edge thereof is attached to the heat dissipation element.

2. The LED lamp according to claim 1, wherein the LED lamp further comprises a power driver between the first electrically conductive elements and the second electrically conductive elements, and the power driver is used to convert the electric power transmitted from the first electrically conductive elements to the second electrically conductive elements.

3. The LED lamp according to claim 1, wherein a lower end of the heat dissipation element is extended toward an axis thereof to form an extension portion which is formed with at least two first fixation units, while the heat dissipation plate is formed with at least two second fixation units, wherein each of the second fixation units is corresponding to and matched with a respective said first fixation unit so that the second fixation units and the first fixation units are allowed to combine with each other.

4. The LED lamp according to claim 2, wherein a lower end of the heat dissipation element is extended toward an axis thereof to form an extension portion which is formed with at least two first fixation units, while the heat dissipation plate is formed with at least two second fixation units, wherein each of the second fixation units is corresponding to and matched with a respective said first fixation unit so that the second fixation units and the first fixation units are allowed to combine with each other.

5. The LED lamp according to claim 1, wherein the second installation portion is a recess and an inner surface thereof has a first thread unit, while the third installation portion is a projected column and an outer surface thereof has a second thread unit which is matched with the first thread unit, so that the second installation portion is allowed to be stably connected to the third installation portion.

6. The LED lamp according to claim 2, wherein the second installation portion is a recess and an inner surface thereof has a first thread unit, while the third installation portion is a projected column and an outer surface thereof has a second thread unit which is matched with the first thread unit, so that the second installation portion is allowed to be stably connected to the third installation portion.

* * * * *